US010131068B2

(12) United States Patent
Wilhelm

(10) Patent No.: US 10,131,068 B2
(45) Date of Patent: Nov. 20, 2018

(54) PRODUCING A REMOVAL AID IN A FOIL OF A FOILED METAL SHEET

(71) Applicant: TRUMPF Werkzeugmaschinen GmbH + Co. KG, Ditzingen (DE)

(72) Inventor: Markus Wilhelm, Stuttgart (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 621 days.

(21) Appl. No.: 14/325,569

(22) Filed: Jul. 8, 2014

(65) Prior Publication Data

US 2014/0322556 A1 Oct. 30, 2014

Related U.S. Application Data

(63) Continuation of application No. PCT/EP2013/050292, filed on Jan. 9, 2013.

(30) Foreign Application Priority Data

Jan. 10, 2012 (DE) ..... 10 2012 200 240

(51) Int. Cl.
*B26D 3/12* (2006.01)
*B26D 3/08* (2006.01)

(52) U.S. Cl.
CPC ..... *B26D 3/12* (2013.01); *B26D 3/085* (2013.01); *Y10T 83/04* (2015.04); *Y10T 83/889* (2015.04); *Y10T 428/12361* (2015.01)

(58) Field of Classification Search
CPC ..... Y10T 83/0491; Y10T 83/0333; Y10T 83/0341; Y10T 83/0348; B26D 3/08; B26D 3/085; B26D 3/10
(Continued)

(56) References Cited

U.S. PATENT DOCUMENTS 2,188,310 A * 1/1940 Price ..... B44C 3/10 283/79
3,787,968 A * 1/1974 Littmann ..... B26D 1/025 30/124

(Continued)

FOREIGN PATENT DOCUMENTS

CN 101332567 A 12/2008
CN 101495677 A 7/2009

(Continued)

OTHER PUBLICATIONS

Notification of Transmittal of translation of the International Preliminary Report on Patentability for corresponding PCT Application No. PCT/EP2013/050292, dated Jan. 13, 2013, 6 pages.

(Continued)

*Primary Examiner* — Stephen Choi
*Assistant Examiner* — Evan MacFarlane
(74) *Attorney, Agent, or Firm* — Fish & Richardson P.C.

(57) ABSTRACT

Methods, systems, and apparatus, including computer programs encoded on a computer storage medium, for producing a foil slitting cut in a foil of a foiled metal sheet. A foil slitting tool is moved along a predetermined path with a tool tip resting on the metal sheet and thereby mechanically produces the foil slitting cut by displacing foil material along the path. The foil slitting cut has at least one acute-angled tooth for forming at least one foil corner detached from the metal sheet.

16 Claims, 5 Drawing Sheets

(58) Field of Classification Search
USPC ..... 156/257, 268
See application file for complete search history.

(56) References Cited

U.S. PATENT DOCUMENTS

| | | | | | |
|---|---|---|---|---|---|
| 4,210,041 | A * | 7/1980 | Mitman | B21D 28/06 | 33/11 |
| 4,373,412 | A * | 2/1983 | Gerber | B26D 1/185 | 83/24 |
| 4,401,001 | A * | 8/1983 | Gerber | B26D 1/185 | 83/451 |
| 4,448,808 | A * | 5/1984 | Pearl | A41H 3/08 | 427/208.6 |
| 5,331,872 | A * | 7/1994 | Fuchigami | B26D 5/02 | 83/171 |
| 2003/0118689 | A1* | 6/2003 | Carlson | B43L 13/206 | 425/193 |
| 2005/0040214 | A1 | 2/2005 | Membrado | | |

FOREIGN PATENT DOCUMENTS

| | | | | |
|---|---|---|---|---|
| DE | 202005011908 | U1 | 10/2005 | |
| EP | 0123953 | B1 | 12/1987 | |
| EP | 1747859 | A1 * | 1/2007 | B26D 3/08 |
| EP | 1964621 | A1 | 9/2008 | |
| JP | 201120224 | A | 2/2011 | |
| WO | 2010074650 | A1 | 7/2010 | |

OTHER PUBLICATIONS

International Search Report from corresponding PCT Application No. PCT/EP2013/050292, dated Mar. 8, 2013, 2 pages.

* cited by examiner

PRODUCING A REMOVAL AID IN A FOIL OF A FOILED METAL SHEET

CROSS REFERENCE TO RELATED APPLICATIONS

This application is a continuation of and claims priority under 35 U.S.C. § 120 to PCT Application No. PCT/EP2013/050292 filed on Jan. 9, 2013, which claimed priority under 35 U.S.C. § 119 to German Application No. DE 10 2012 200 240.5 filed on Jan. 10, 2012. The content of these priority applications are hereby incorporated by reference in their entirety.

TECHNICAL FIELD

The present invention relates to methods, devices, and systems for producing a foil slitting cut in a foil of a foiled metal sheet, particularly for producing a removal aid in the foil.

BACKGROUND

Methods for slitting foiled metal sheets have become known, for example, by the so-called "TRUMPF foil slitting tool". Foiled metal sheets are provided with a protective foil which protects the metal sheet from damage during processing, storage and handling and which in most cases is only removed immediately before the metal sheet is processed further.

The TRUMPF foil slitting tool has a ball which is rotatably mounted in a die and which is moved on a foiled metal sheet with a rolling movement and thereby slits the foil without leaving scratches or marks on the metal sheet. More precisely, the ball is set onto the surface of the metal sheet during processing, whereby the tip of the ball pierces the foil and then rolls on the metal sheet as it is moved over the metal sheet. In this manner, the foil is cut simply and quickly along the path that is travelled. In particular, separate areas or segments can be separated on the foil by means of the foil slitting tool and can then be removed from the metal sheet manually. However, the slitting gap produced by the foil slitting tool is naturally very narrow and therefore does not facilitate the manual detachment of the foil or of a foil segment.

Also known as removal aids for the detachment of the foil are acute-angled "foil marking tools", for example in the form of a pointed brass needle. The brass needle is softer than the metal sheet, so that there are no scratches on the metal sheet, but the brass needle becomes worn and must be replaced often. If scratches on the sheet are not important, a harder tip can also be used, which lasts longer but scratches the metal sheet.

SUMMARY

One aspect of the invention features a method for producing a foil slitting cut in a foil of a foiled metal sheet by a foil slitting tool which is moved along a predetermined path with a tool tip resting on the metal sheet and thereby produces the foil slitting cut mechanically by displacing foil material.

In order to form at least one foil corner that is detached from the metal sheet, in various aspects of the invention the foil slitting cut has at least one acute-angled tooth. This can provide a more easily removed foil or foil segment.

In some embodiments, a special slitting cut contour with one or more acute-angled slitting teeth is cut with the foil slitting tool. With such a slitting tooth of less than 90 degrees, preferably of less than 45 degrees without lifting the foil slitting tool, the foil curls up at the reversal point of the processing direction and the associated acute-angled foil corner is thereby detached, which facilitates the manual removal of the foil or of a foil segment. The detached foil corner accordingly represents a removal aid.

Preferably, the tool tip is rotationally symmetrical and in particular is formed by a rotatably mounted ball which is moved on the metal sheet with a rolling movement and thereby cuts the foil. Alternatively, the tool tip can also be formed by the needle tip of a pointed needle.

In an advantageous variant of the method according to the invention, the foil slitting cut has a plurality of acute-angled teeth which are arranged in a suitable sequence next to one another. A plurality of acute-angled points means many detached foil corners, which are available as removal aids. In particular in the case of a plurality of acute-angled teeth oriented in the same direction, these can be joined to one another by curved slitting cut portions, so that uncontrolled tearing of the foil is prevented when the foil or foil segment is subsequently removed.

The foil slitting cut preferably has at least one zigzag portion with a plurality of acute-angled teeth arranged next to one another and oriented in opposite directions. Provided that the teeth are located sufficiently short and close together, the foil lifts off on both sides of the two opposing rows of teeth, so that a continuous slitting gap is formed, which is wider than the actual foil slitting cut.

The foil slitting cut can either be formed at a distance from the outside edges of the foil or from the segment edges of a foil segment cut in the foil, or it can extend to an outside edge or segment edge on one side or on both sides. In the latter case, it is advantageous if the foil slitting cut merges into the outside edge or segment edge asymptotically or at an acute angle, in order to prevent uncontrolled tearing of the foil or foil segment when it is removed.

The foil slitting cut that cuts the acute-angled tooth can either be formed as a single continuous cut, that is to say without lifting the foil slitting tool off the metal sheet, or can be in the form of two non-continuous cuts, of which the cut made last either begins in the cutting gap of the cut made first or runs at least partially therein.

In a further aspect, the invention relates also to a foiled metal sheet processed by this method and having at least one foil slitting cut. The foil slitting cut has at least one acute-angled tooth and the associated acute-angled foil corner is detached from the metal sheet.

Another aspect of the invention features a metal-sheet processing machine including a foil slitting tool, a tool receptacle for receiving the foil slitting tool, a workpiece support for a foiled metal sheet to be processed, and a control system. The supported foiled metal sheet and the tool receptacle are configured to be moved relative to one another in x-, y- and z-direction. The control system is configured to carry out the method as discussed above.

Other aspects of the invention feature a computer program product and a CAD/CAM system for writing an NC program for the metal-sheet processing machine. The computer program product includes a non-transitory computer readable storage medium storing instructions executable by a data processing apparatus and upon such execution cause the metal-sheet processing machine to perform operations for producing a foil slitting cut in a foil of a foiled metal sheet. The operations include placing a tool tip of a foil slitting tool on the foiled metal sheet, and moving the foil slitting tool along a predetermined path with the tool tip resting on the foiled metal sheet, thereby mechanically producing a foil slitting cut having at least one acute-angled tooth by displacing foil material along the path to form at least one foil corner detached from the foiled metal sheet.

Further advantages of the invention will become apparent from the claims, the description and the drawing. The features mentioned above and those listed below can likewise be used individually or a plurality can be used in arbitrary combinations. The embodiments shown and described are not to be understood as being an exhaustive list; on the contrary, they are of an exemplary nature for illustrating the invention.

DESCRIPTION OF DRAWINGS

In the following description of the drawing, identical reference numerals are used for components which are the same or have the same function.

DETAILED DESCRIPTION

Figure 2:
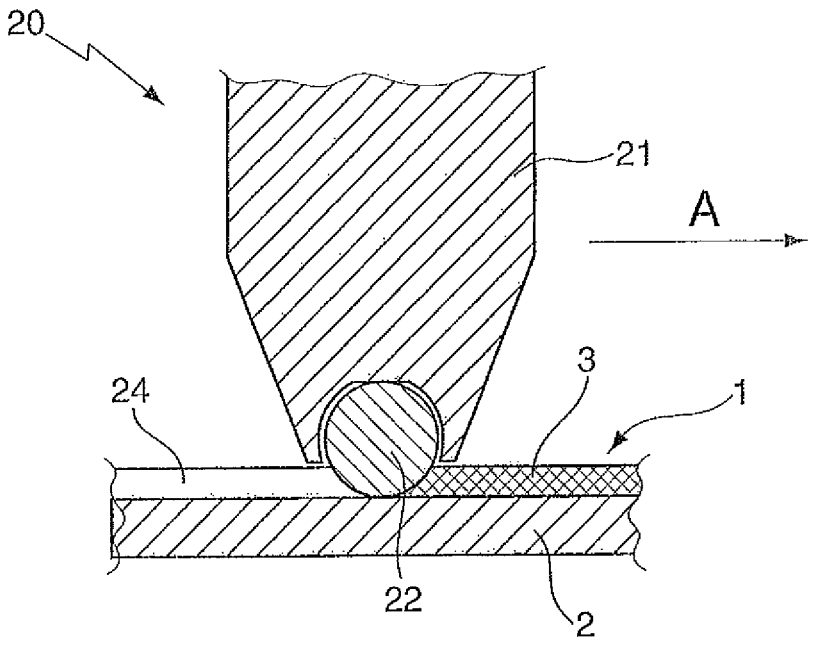
Fig. 2 (Prior Art)
FIG. 2 shows a longitudinal section of a known foil slitting tool for producing the foil slitting cuts shown in FIG. 1.

FIG. 2 shows a known foil slitting tool 20 for foiled metal sheets 1, that is to say, for metal sheets 2 which are provided with a foil 3 to protect them against damage. The foil slitting tool 20 serves to produce a foil slitting cut 24 in the foil 3 of the foiled metal sheet 1 without leaving scratches or marks on the metal sheet 2.

The foil slitting tool 20 has a blunt tool tip in the form of a ball 22 which is rotatably mounted in a die 21 and which is moved on the foiled metal sheet 1 with a rolling movement and thereby cuts the foil 3. More precisely, the ball 22 pierces the foil 3 and, when the foil slitting tool 20 is moved over the foiled metal sheet 1 in direction A, rolls on the metal sheet 2 and thereby produces the foil slitting cut 24 mechanically by displacing foil material along the path that is travelled.

Figure 3:
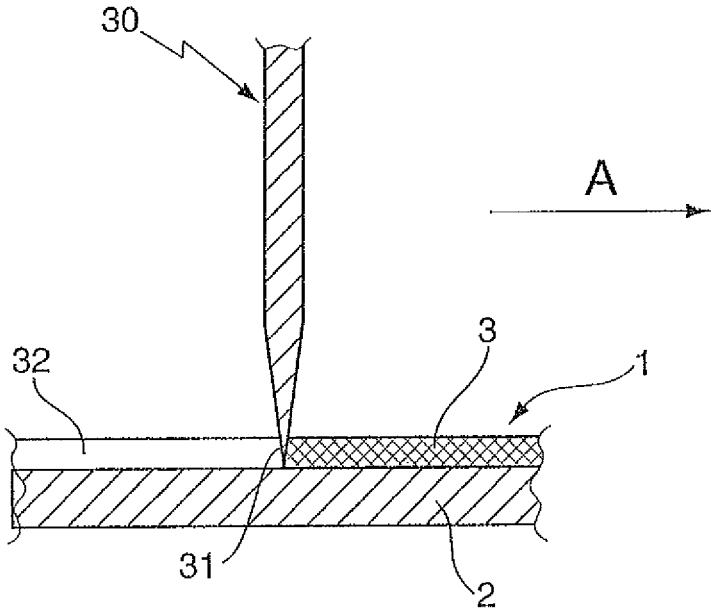
Fig. 3 (Prior Art)
FIG. 3 shows a longitudinal section of a further known foil slitting tool for producing the foil slitting cuts shown in FIG. 1.

FIG. 3 shows a further known foil slitting tool ("foil marking tool") in the form of a pointed needle 30. The needle 30 is moved on the foiled metal sheet 1 and thereby cuts the foil 3. More precisely, the needle tip 31 pierces the foil 3 and, when the needle 30 is moved over the foiled metal sheet 2 in direction A, produces the foil slitting cut 32 mechanically by displacing foil material along the path that is travelled. If the needle tip 31 is made of a softer material than the metal sheet, for example of brass, there are no scratches on the metal sheet 2. If scratches on the metal sheet 2 are not important, a needle tip 31 made of a harder material than the metal sheet can also be used.

Figure 1:
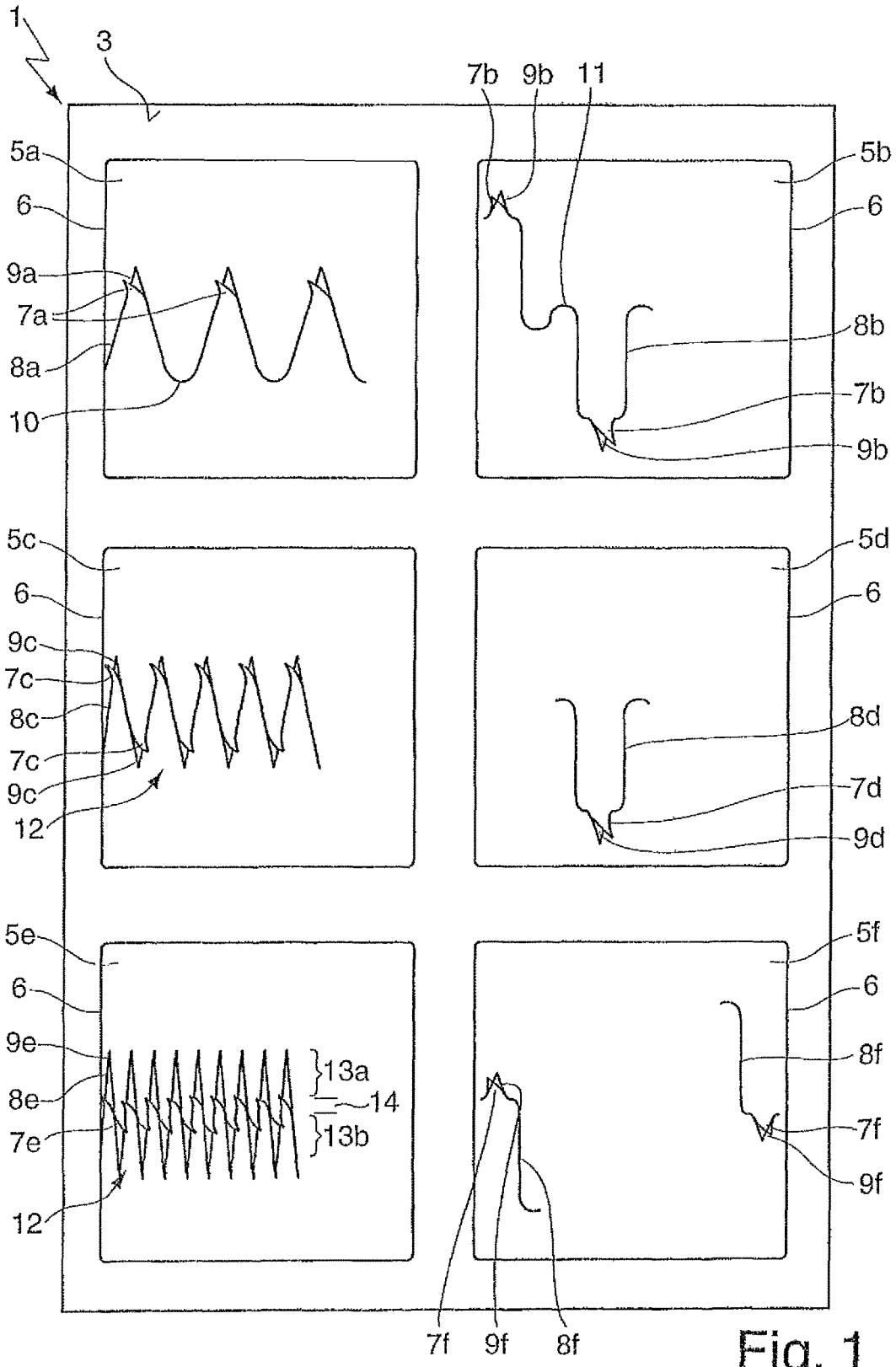
FIG. 1 shows a foiled metal sheet having a plurality of foil segments separated from one another, each having different foil slitting cuts according to the invention for forming a foil corner detached from the metal sheet.

FIG. 1 shows a foiled metal sheet 1 in the foil 3 of which six square foil segments 5*a*-5*f* have been cut in each case by means of a closed slitting gap 6. If welding work, for example, is to be carried out on the metal sheet 1 at specific processing locations, the foil segment in question only has to be removed manually from those processing locations. However, in the case of a ball diameter of less than 1 mm, the slitting gap 6 produced with the foil slitting tool 20 is very narrow (less than 0.5 mm) and consequently does not facilitate the manual detachment of a foil segment.

Therefore, each of the foil segments 5*a*-5*f* has, as a removal aid, at least one foil corner 7*a*-7*f* which is detached from the metal sheet 2 and can be gripped by hand. These detached foil corners 7*a*-7*f* are formed in the respective foil segments 5*a*-5*f* as follows: in each of the foil segments 5*a*-5*f* there is formed, by means of the foil slitting tool 20, an additional foil slitting cut 8*a*-8*f* which has at least one acute-angled tooth 9*a*-9*f*. When the foil 3 is slit at an acute angle of less than 90 degrees, preferably of less than 45 degrees without lifting the foil slitting tool 20, the foil 3 curls up at the reversal point of the processing direction, that is to say, at the tip of the tooth. The associated acute-angled foil corner 7*a*-7*f* is thereby detached from the metal sheet 2 and projects upwards as a removal aid.

In foil segments 5*a*-5*c*, 5*e*, 5*f*, the foil slitting cut 8*a*-8*c*, 8*e*, 8*f* extends to the slitting gap 6, that is to say, to the segment edge of the foil segment 5*a*, only on one side and merges into the segment edge at an acute angle of less than 90 degrees, in order to prevent the foil or foil segment from tearing uncontrollably when it is removed. Alternatively, the foil slitting cut can also extend to the segment edge of the foil segment on both sides.

In foil segment 5*a*, the foil slitting cut 8*a* has three acute-angled teeth 9*a* which are oriented in the same direction and are joined to one another by curved slitting cut portions 10. In total, therefore, there are three detached foil corners 7*a*.

In foil segment 5*b*, the foil slitting cut 8*b* has two acute-angled teeth 9*b* which are oriented in opposite directions and are joined to one another by an S-shaped slitting cut portion 11. In total, therefore, there are two detached foil corners 7*b*.

In foil segment 5*c*, the foil slitting cut 8*c* has a zigzag portion 12 with a plurality of acute-angled teeth 9*c* which are arranged next to one another and are oriented alternately in opposite directions, as a result of which a plurality of detached foil corners 7*c* are formed. Generally, the more acute-angled the teeth, the easier they are to detach.

In foil segment 5*d*, the foil slitting cut 8*b* has a single acute-angled tooth 9*d* between two S-shaped curve portions 11. The foil slitting cut 8*d* is at a distance from the segment edge on both sides, that is to say, it is formed wholly within the foil segment 5*d*.

In foil segment 5*e*, the foil slitting cut 8*e* has a zigzag portion 12, the teeth 9*e* of which are so acute-angled and are arranged so shortly and closely together that there is a continuous slitting gap 14 between the detached foil corners 7*e* of the two rows of teeth 13*a*, 13*b* oriented in opposite directions, which slitting gap 14 is wider than the foil slitting cut 8*e* of the foil slitting tool 20. The foil corners 7*e* detached on both sides of the slitting gap 14 each form a foil edge which can be used as a removal aid.

In foil segment 5*f* there are formed two foil slitting cuts 8*f* which are separate from one another and each of which has an acute-angled tooth 9*f* and an S-shaped slitting cut portion 11 extending to the segment edge. In total, therefore, there are two detached foil corners 7*f*.

Figure 4:
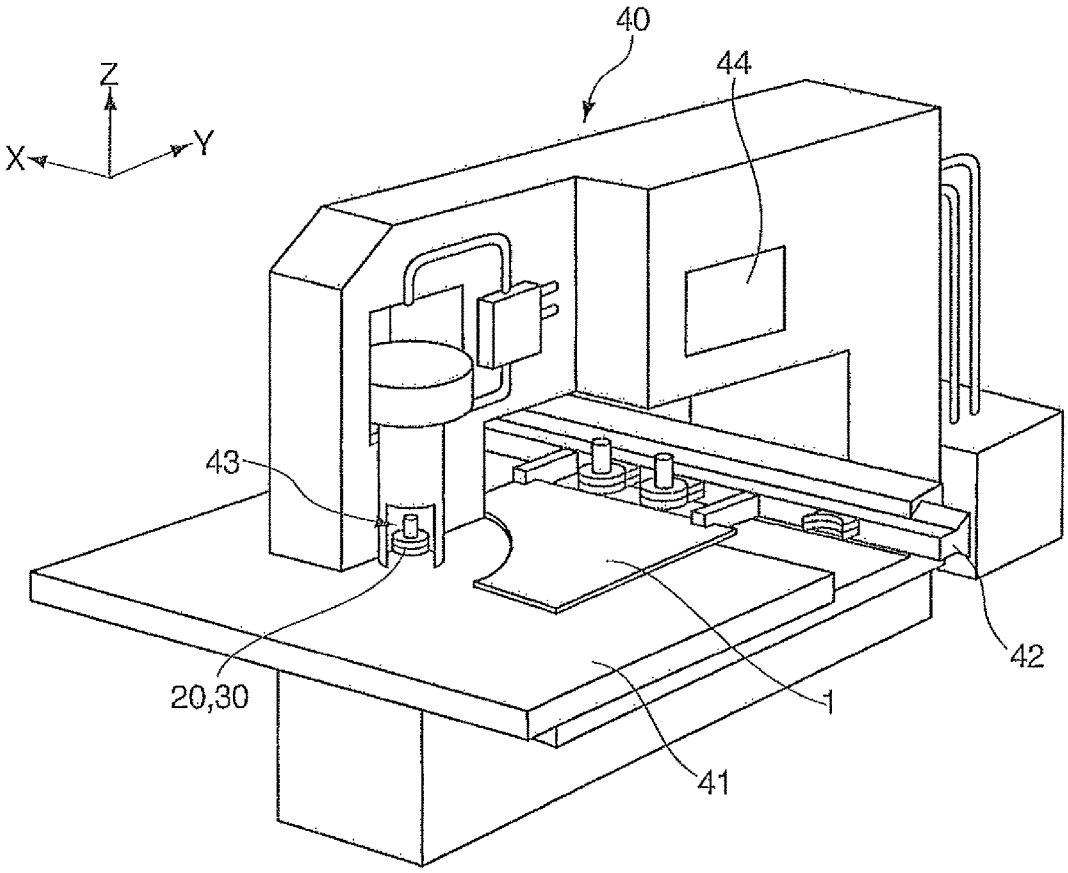
FIG. 4 shows a metal-sheet processing machine for carrying out the method according to the invention.

FIG. 4 shows a numerically controlled metal-sheet processing machine 40 with which the above-described slitting cuts with acute-angled teeth can be formed in a foiled metal sheet 1. This metal-sheet processing machine 40 comprises a workpiece support 41 for holding a foiled metal sheet 1, a workpiece movement system 42 for moving the foiled metal sheet 1 located on the workpiece support 41 in the x- and y-direction, a tool receptacle 43 which is movable in the z-direction and receives the foil slitting tool 20, 30, and an NC machine control system 44 (not shown in detail) which is programmed by means of an NC program and which controls actuators of the workpiece movement system 42 and the tool receptacle 43 in order to execute the above-described slitting cuts with acute-angled points in the foiled metal sheet 1.

Figure 5:
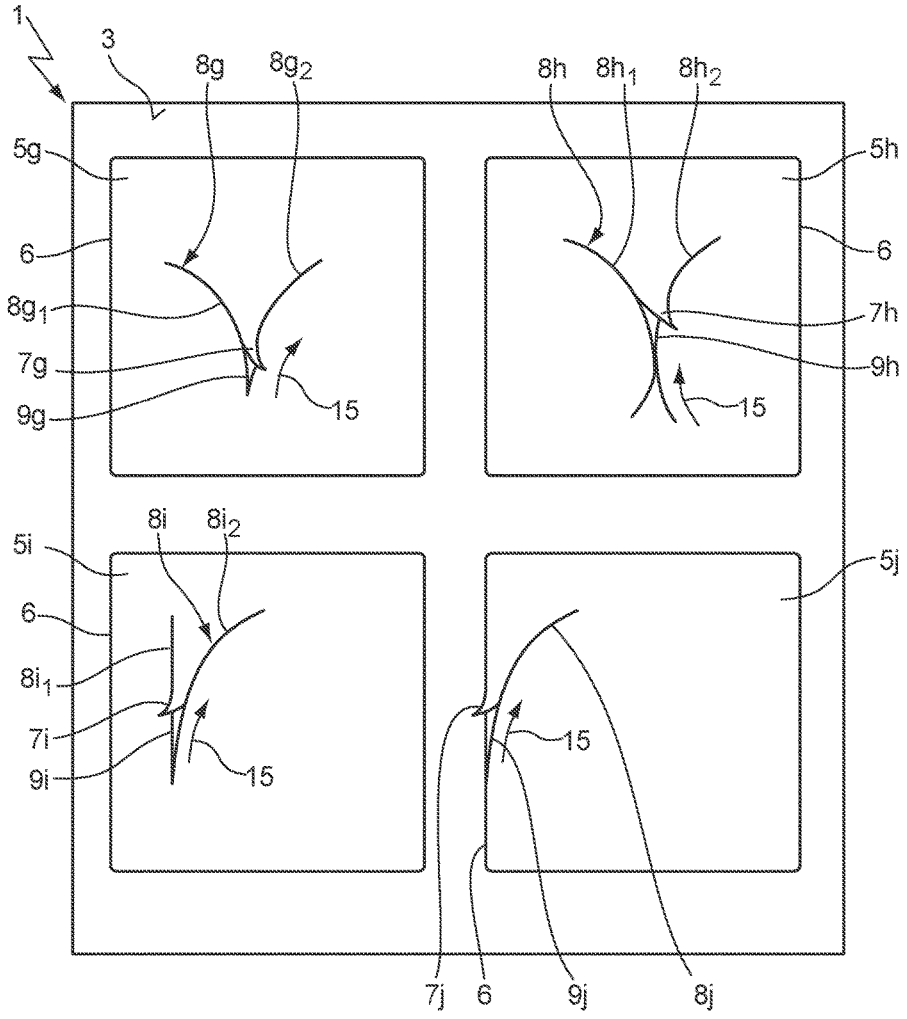
FIG. 5 shows a further foiled metal sheet having a plurality of foil segments separated from one another, each having further foil slitting cuts according to the invention for forming a foil corner detached from the metal sheet.

FIG. 5 shows a further foiled metal sheet 1 in the foil 3 of which four square foil segments 5*g*-5*j* have been cut in each case by means of a closed slitting gap 6. Each of the foil segments 5*g*-5*j* has, as removal aid, at least one foil corner 7*g*-7*j* which is detached from the metal sheet 2 and can be gripped by hand. In order to form these detached foil corners 7*g*-7*j* there is formed in each of the foil segments 5*g*-5*j*, by means of the foil slitting tool 20, an additional foil slitting cut 8*g*-8*j* which has an acute-angled tooth 9*g*-9*j* with an acute angle of less than 90 degrees, preferably of less than 45 degrees. The foil 3 curls up at the tip of the tooth. The associated acute-angled foil corner 7*g*-7*j* is thereby detached from the metal sheet 2 and projects upwards as a removal aid.

In foil segment 5*g*, the foil slitting cut 8*g* has an acute-angled tooth 9*g*, which are formed by two mutually facing curved slitting cut portions $\mathbf{8}g_1$, $\mathbf{8}g_2$ which extend acutely or asymptotically relative to one another and meet at the tip of the tooth. The two slitting cut portions $\mathbf{8}g_1$, $\mathbf{8}g_2$ can be cut as a continuous cut, that is to say without lifting the foil slitting tool 20, whereby the foil 3 curls up at the reversal point of the processing direction, that is to say at the tip of the tooth, and the acute-angled foil corner 7*g* is thereby detached from the metal sheet 2 and projects upwards as a removal aid. The two slitting cut portions $\mathbf{8}g_1$, $\mathbf{8}g_2$ can also be two non-continuous cuts, and the cut made last (e.g., the slitting cut portion $\mathbf{8}g_2$) begins in the cutting gap of the slitting cut portion $\mathbf{8}g_1$ made first and extends away from the tip of the tooth in the cutting direction 15.

In foil segment 5*h*, the foil slitting cut 8*h* has an acute-angled tooth 9*h* which is formed by two mutually facing curved slitting cut portions $\mathbf{8}h_1$, $\mathbf{8}h_2$, which touch at a cutting point and each extend further on both sides of this cutting point. The two slitting cut portions $\mathbf{8}h_1$, $\mathbf{8}h_2$ are two non-continuous cuts, and the cut made last (e.g. the slitting cut portion $\mathbf{8}h_2$) comes from the cutting direction 15, that is to say from the side of the cutting point remote from the foil corner 7*h* to be detached, and runs partially in the cutting gap of the slitting cut portion $\mathbf{8}h_1$ made first.

The foil slitting cut 8*i* of foil segment 5*i* differs from the foil slitting cut 8*g* only in that only one slitting cut portion $\mathbf{8}i_2$ is curved and the other slitting cut portion $\mathbf{8}i_1$ is straight.

The foil slitting cut 8*j* of foil segment 5*j* differs from the foil slitting cut 8*i* only in that the straight slitting cut portion is here formed by the slitting gap 6 and the curved slitting cut 8*j* begins in the slitting gap 6 and is then formed in direction 15 in order to detach the foil corner 7*j*.

Tests with the foil slitting tool 20 (cut width 1 mm) have shown that the method according to the invention for forming detached foil corners 7*a*-7*j* works at any movement speed possible with the metal-sheet processing machine 40 used (maximum movement speed: 60 m/min).

A number of embodiments of the invention have been described. Nevertheless, it will be understood that various modifications may be made without departing from the spirit and scope of the invention. Accordingly, other embodiments are within the scope of the following claims.

What is claimed is:

1. A method of producing a foil slitting cut in a foil of a foiled metal sheet, the method comprising:

placing a tool tip of a foil slitting tool on the foiled metal sheet;

moving the foil slitting tool to produce a closed slitting gap in the foiled metal sheet to form a foil segment cut for a foil segment to be removed; and additionally moving the foil slitting tool along a predetermined path with the tool tip resting on the foiled metal sheet to mechanically produce an additional foil slitting cut in the foil segment cut, the additional foil slitting cut having at least one acute-angled tooth with foil material displaced along the path to form at least one foil corner that is automatically detached away from the foiled metal sheet and projects upwards, removing the foil segment by initially grasping the detached foil corner, the detached foil corner remaining connected with the foil segment.

2. The method of claim 1, wherein the tool tip comprises a rotatably mounted ball, and wherein moving the foil slitting tool comprises rolling the rotatably mounted ball on the foiled metal sheet.

3. The method of claim 1, wherein the tool tip comprises a needle tip of a pointed needle.

4. The method of claim 1, wherein mechanically producing the additional foil slitting cut comprises slitting the foiled metal sheet at an acute angle without lifting the foil slitting tool from the foiled metal sheet, such that the foil material curls up at a tip of the at least one acute-angled tooth to thereby form the at least one foil corner detached away from the foiled metal.

5. The method of claim 1, wherein the additional foil slitting cut has a plurality of acute-angled teeth oriented in a common direction and joined to one another by curved slitting cut portions.

6. The method of claim 1, wherein the additional foil slitting cut has at least one zigzag portion with a plurality of acute-angled teeth arranged next to one another and oriented in opposite directions and forming two rows of teeth.

7. The method of claim 6, wherein the teeth of the at least one zigzag portion are arranged such that a continuous slitting gap is formed between the detached foil corners of the two rows of teeth oriented in opposite directions, the slitting gap being wider than the additional foil slitting cut.

8. The method of claim 1, wherein the additional foil slitting cut extends to an outside edge of the foil or to an edge of the foil segment cut in the foil.

9. The method of claim 8, wherein the additional foil slitting cut merges into the outside edge or segment edge asymptotically or at an acute angle.

10. The method of claim 1, wherein the additional foil slitting cut is spaced from any existing edges of the foil as produced.

11. The method of claim 1, wherein mechanically producing the additional foil slitting cut comprises forming the additional foil slitting cut by a single continuous cut without lifting the foil slitting tool from the foiled metal sheet.

12. The method of claim 1, wherein mechanically producing the additional foil slitting cut comprises making a first non-continuous cut and then making a second non-continuous cut either beginning in a cutting gap produced by the first non-continuous cut or running at least partially therein.

13. The method of claim 1, wherein the additional foil slitting cut extends to the closed slitting gap on a segment edge of the foil segment and merges into the segment edge at an acute angle of less than 90 degrees.

14. The method of claim 1, wherein the predetermined path is configured such that the foil material automatically curls up at a reversal point of a direction of the moving to form the at least one foil corner that has a corresponding acute-angle and is detached from the foiled metal sheet.

15. The method of claim 1, wherein the predetermined path is a single path of the additional foil slitting tool, and the at least one acute-angled tooth in the foil slitting cut is produced by the tool tip resting on the foiled metal sheet and moving along the single predetermined path.

16. A method of removing a foil segment of a foiled metal sheet, the method comprising:

placing a tool tip of a foil slitting tool on the foiled metal sheet;

moving the foil slitting tool to produce a closed slitting gap in the foiled metal sheet to form a foil segment cut for a foil segment to be removed;

additionally moving the foil slitting tool along a predetermined path to mechanically produce an additional single foil slitting cut in the foil segment with the tool tip resting on the foiled metal sheet, wherein the predetermined path is configured such that the additional single foil slitting cut is produced to have at least one acute-angled tooth to result in at least one foil corner that is detached from the foiled metal sheet to curl up; then removing the foil segment by initially grasping the at least one detached foil corner as a removal aid, the at least one detached foil corner remaining connected with the foil segment.

* * * * *